US011795643B2

(12) United States Patent
Chen et al.

(10) Patent No.: US 11,795,643 B2
(45) Date of Patent: Oct. 24, 2023

(54) METHOD FOR CONSTRUCTING INNER DUMP TYPE STRIP MINE PIT BOTTOM RESERVOIRS SECTION BY SECTION

(71) Applicants: CHINA UNIVERSITY OF MINING AND TECHNOLOGY, Xuzhou (CN); XUZHOU TIANLUZHONGKUANG MINING TECHNOLOGY CO., LTD., Xuzhou (CN)

(72) Inventors: Shuzhao Chen, Xuzhou (CN); Liu Han, Xuzhou (CN); Cangyan Xiao, Xuzhou (CN); Tao Shang, Xuzhou (CN)

(73) Assignee: CHINA UNIVERSITY OF MINING AND TECHNOLOGY, Jiangsu (CN)

( * ) Notice: Subject to any disclaimer, the term of this patent is extended or adjusted under 35 U.S.C. 154(b) by 70 days.

(21) Appl. No.: 17/619,102

(22) PCT Filed: Feb. 29, 2020

(86) PCT No.: PCT/CN2020/077329
§ 371 (c)(1),
(2) Date: Dec. 14, 2021

(87) PCT Pub. No.: WO2020/253264
PCT Pub. Date: Dec. 24, 2020

(65) Prior Publication Data

US 2022/0267974 A1 Aug. 25, 2022

(30) Foreign Application Priority Data

Jun. 20, 2019 (CN) ..... 201910535710.7

(51) Int. Cl.
*E02B 3/00* (2006.01)
*E02D 17/04* (2006.01)

(52) U.S. Cl.
CPC ..... *E02B 3/00* (2013.01); *E02D 17/04* (2013.01); *E02D 2300/002* (2013.01); *E02D 2300/0037* (2013.01)

(58) Field of Classification Search
CPC ..... E02B 3/00; E02D 17/04; E02D 2300/002; E02D 2300/0037; E02D 17/02; E21C 41/32; E21C 41/26
See application file for complete search history.

(56) References Cited

U.S. PATENT DOCUMENTS 3,762,771 A * 10/1973 Livingston ..... E21C 41/32 299/19
3,848,927 A * 11/1974 Livingston ..... E21C 41/32 299/13

(Continued)

FOREIGN PATENT DOCUMENTS

CN 109057799 A 12/2018
CN 109779820 A 5/2019

(Continued)

OTHER PUBLICATIONS

International Search Report and Written Opinion for corresponding PCT Patent No. PCT/CN2020/077329 dated May 19, 2020.

*Primary Examiner* — Carib A Oquendo
(74) *Attorney, Agent, or Firm* — TAROLLI, SUNDHEIM, COVELL & TUMMINO L.L.P.

(57) ABSTRACT

The present invention discloses a method for constructing inner dump type strip mine pit bottom reservoirs section by section, specifically including the following steps: S1: processing end slopes: discarding clay at a lowest step of an inner waste dump of a strip mine; S2: discharging concrete to slope faces of lowest steps of the end slopes on two sides of a pit bottom; S3: sealing the bottom; S4: discarding gravel into a pit of the strip mine; S5: laying geotextile; S6: re-adopting clay on the lowest steps of the end slopes of the (Continued)

inner waste dump, so as to form a reservoir sealing isolation layer; S7: constructing a plurality of reservoirs step by step in an advancing direction of the strip mine; S8: storing water resources: completing installation of water storage wells; S9: completing installation of water fetching wells; S10: storing water resources.

8 Claims, 2 Drawing Sheets

(56) References Cited

U.S. PATENT DOCUMENTS

| | | | | |
|---|---|---|---|---|
| 11,085,296 | B2 * | 8/2021 | Ju | E21F 15/00 |
| 2011/0169264 | A1 | 7/2011 | Choate | |

FOREIGN PATENT DOCUMENTS

| | | | |
|---|---|---|---|
| CN | 109854248 | A | 6/2019 |
| CN | 110409359 | A | 11/2019 |
| FR | 2749330 | B1 | 9/1998 |
| SU | 1223958 | A1 | 4/1986 |

* cited by examiner

METHOD FOR CONSTRUCTING INNER DUMP TYPE STRIP MINE PIT BOTTOM RESERVOIRS SECTION BY SECTION

RELATED APPLICATIONS

The present invention is a U.S. National Stage under 35 USC 371 patent application, claiming priority to Serial No. PCT/CN2020/077329, filed on Feb. 29, 2020; which claims priority from Chinese Patent Application No. 201910535710.7 filed Jun. 20, 2019, the entirety of both of which are incorporated herein by reference.

FIELD OF THE INVENTION

The present invention relates to a method for constructing inner dump type strip mine pit bottom reservoirs section by section, and belongs to the fields of mining and environmental protection.

DESCRIPTION OF RELATED ART

In northern China, the climate is arid, and the annual amount of evaporation is greater than the amount of precipitation, leading to scarce water resources. The surface open-air water storage device has great evaporation loss of water resources in the water storage process, leading to huge waste of resources. Constructing a sealed water storage device costs a lot and occupies a lot of space, leading to significant increase in cost of water storage for enterprises.

Strip mining is a process of removing the covering on the ore body and extracting useful minerals from the open stope. Inner dump type strip mine refers to a working method that, in the mining process of a strip mine, stripped materials are directly discarded into a mined-out area to form an inner waste dump, and the inner waste dump and the mining steps of the strip mine are advanced at the same time. Huge pits may be formed during strip mining. Most strip mines in northern China are near horizontal strip mines. In order to ensure the effective recovery of the environment in the mining area after mining, the mined-out area is generally directly backfilled instead of comprehensive utilization, which greatly wastes the space formed by excavation. Meanwhile, in order to ensure the recovery of the environment in the mining area, planting and greening will be carried out on the surface of the pit after backfilling, which increases the storage demand for water resources in the mining area.

Therefore, for the reasons of the difficulty in water storage in northern China, the water demand for environmental governance in the mining areas, or the consideration of comprehensive utilization of the pits, it is required to effectively integrate the pit resources and storage of water resources so as to avoid the waste of pit space resources, while providing an effective solution for the storage of water resources.

SUMMARY OF THE INVENTION

Technical Problem

In view of the above problems in the prior art, an objective of the present invention is to provide a method for constructing inner dump type strip mine pit bottom reservoirs section by section. In view of less water resources in strip mine areas in northern China, the method solves the problem of low utilization rate of water resources in mining areas, and improves the utilization rate of pits, while reducing the mining cost of strip mines.

Technical Solution

In order to achieve the above objective, the present invention adopts the following technical solution:

A method for constructing inner dump type strip mine pit bottom reservoirs section by section includes the procedures of single reservoir construction, multi-reservoir section-by-section construction and water resource storage, and specifically includes the following steps:

S1: processing side slopes: discarding 5-10-meter-thick clay at a lowest step of an inner waste dump of a strip mine when the width of a constructed pit bottom of the strip mine reaches about 150-300 m, so as to form a waste dump isolation layer, and stopping advancing of the inner waste dump of the strip mine after the waste dump isolation layer is formed;

S2: after processing the side slopes, discharging concrete to slope faces of lowest steps of the end slopes on two sides of the pit bottom of the strip mine by adopting a guniting mode, so as to form an end slope isolation layer, thus completing end slope processing;

S3: carrying out concrete guniting on the pit bottom of the strip mine, and filling the pit bottom with the concrete and performing compaction to seal the bottom, so as to form a pit bottom isolation layer, wherein the laying thickness is 2-5 m, a slope is formed from the surface of the pit bottom isolation layer to the end slopes on the two sides, and the pit bottom is relatively high in the middle, and relatively low near the end slopes on the two sides;

S4: after sealing the bottom, starting discarding gravel into a pit of the strip mine, wherein the discarded gravel is massive gravel having larger pores that is stripped from the strip mine and does not disintegrate while touching water, and the height of the discarded gravel is the height of the lowest steps of the end slopes of the strip mine;

S5: during gravel discarding, laying geotextile when the gravel reaches the height of the lowest steps of the end slopes, so as to form a roof isolation layer, and completing capping work after the roof isolation layer is formed, wherein waste is normally dumped in the upper waste dump at the same time;

S6: with gradual forward advancement of the pit of the strip mine, re-adopting clay on the lowest steps of the end slopes of the inner waste dump while it reaches 150-300 m, so as to form a reservoir sealing isolation layer, wherein the construction of a single pit bottom reservoir is completed, namely, reservoir sealing is realized, and a plurality of sets of moisture sensors are arranged symmetrically on two sides of each isolation layer to monitor soil moisture in the location in real time;

S7: after the completion of construction of the single reservoir, repeating the above steps: constructing a plurality of reservoirs step by step along with advancement of the strip mine in an advancing direction of the strip mine, i.e. a direction from the inner waste dump to a stope, so as to form section-by-section reservoirs;

S8: then storing water resources: firstly completing installation of water storage wells: during the construction of the single reservoir, directionally drilling holes in the end slopes on the two sides of the strip mine obliquely downward from the surface, and burying water pipes, wherein one end of each of the drill holes is located on the surface, and the other end of the drill hole is located in the lower part of the roof isolation layer of the reservoir;

S9: then continuing to complete installation of water fetching wells: during the construction of the single reservoir, directionally drilling holes in the end slopes on the two sides of the strip mine obliquely downward from the surface to form the water fetching wells, and installing pumping units, wherein one end of each of the water fetching wells is located on the surface of the strip mine, and the other end of the water fetching well is located in the upper part of the pit bottom isolation layer of the pit bottom reservoir and near the end slopes;

S10: finally storing the water resources: after the completion of construction of the single reservoir, injecting the water resources into the pit bottom reservoir via the water storage wells, wherein the water resources are stored in the pores of the gravel, and when water is needed, the water resources are pumped to the surface via the water fetching wells.

Further, the pit bottom isolation layer in step S3 is capable of being replaced with compacted clay.

Further, the slope in step S3 is set as a gradient of 0.3%.

Further, the guniting thickness of the end slope isolation layer in step S2 is 20-50 cm.

Further, during gravel discarding in step S5, the gravel is laid to a height higher than the lowest steps of the end slopes, and at this time, the height of the corresponding isolation layer is also increased accordingly, so that the sealing property of the reservoir is ensured.

Advantageous Effect

The present invention has the following beneficial effects: Reservoir construction and water storage are carried out by using the pit bottom of the strip mine, which realizes deep in-situ multiple circular storage of water resources and reduces water evaporation. Most raw materials for reservoir construction, such as clay, are from the strip mine itself, there is no need for outsourcing, and thus the construction cost of the reservoir is reduced. Meanwhile, the space resources of the pit bottom of the strip mine are made full use of, and a water resource guarantee is provided for the environmental governance of the strip mine. The moisture sensors monitor sealing of the reservoir in real time, a damaged reservoir can be promptly discarded, and water storage loss is reduced. The overall construction process can be connected with the production of the strip mine, no additional strip mine production process is added, and the increase in the production cost of the strip mine itself is avoided.

In the figures, 1 denotes an inner waste dump, 2 denotes an inner waste dump isolation layer, 3 denotes a lowest step of an end slope, 4 denotes a pit bottom, 5 denotes a stope, 6 denotes an end slope isolation layer, 7 denotes a pit bottom isolation layer, 8 denotes gravel, 9 denotes a roof isolation layer, 10 denotes a reservoir sealing isolation layer, 11 denotes a water storage well, and 12 denotes a water fetching well.

DETAILED DESCRIPTION OF THE INVENTION

The present invention will be further described in detail below with reference to the accompanying drawings.

Figure 1:
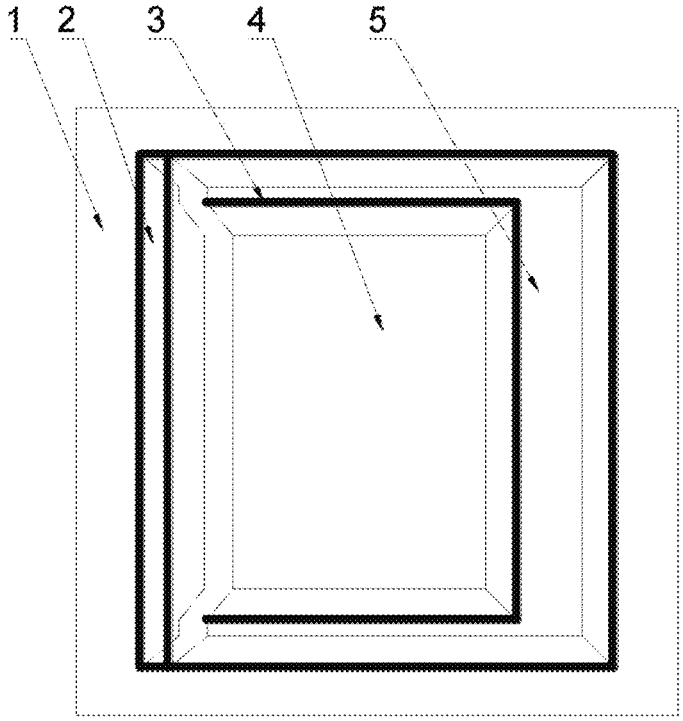
FIG. 1 is a schematic top view of an inner dump type strip mine.

As shown in FIG. 1, a method for constructing inner dump type strip mine pit bottom reservoirs section by section includes the procedures of single reservoir construction, multi-reservoir section-by-section construction and water resource storage, and specifically includes the following steps:

S1: Side slopes are processed. 5-10-meter-thick clay is discarded at a lowest step of an inner waste dump 1 of a strip mine when the width of a constructed pit bottom 4 of the strip mine reaches about 150-300 m, so as to form an inner waste dump isolation layer 2. Advancing of the inner waste dump 1 of the strip mine is stopped after the inner waste dump isolation layer 2 is formed.

S2: After processing the side slopes, concrete is discharged to slope faces of lowest steps 3 of the end slopes on two sides of the pit bottom 4 of the strip mine by adopting a guniting mode, so as to form an end slope isolation layer 6, thus completing end slope processing. Preferably, the guniting thickness of the end slope isolation layer 6 is 20-50 cm. Within this range, not only can isolation of water resources be ensured, but also the usage amount of the concrete can be reduced, and thus the production cost is reduced.

Figure 2:
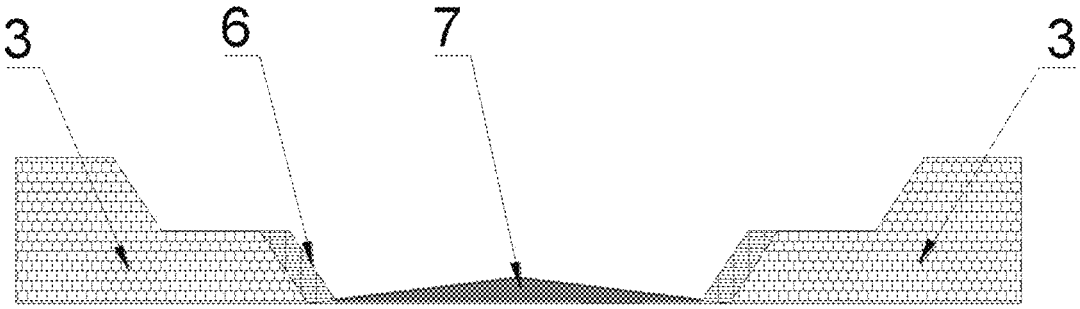
FIG. 2 is a schematic structural view of a pit bottom isolation layer.

S3: As shown in FIG. 2, concrete guniting is carried out on the pit bottom 4 of the strip mine. The pit bottom is filled with the concrete and compaction is performed to seal the bottom, so as to form a pit bottom isolation layer 7. The laying thickness is 2-5 m. In order to guide the water resources, a gradient having a slope of 0.3% is formed from the surface of the pit bottom isolation layer 7 to the end slopes on the two sides. The pit bottom 4 is relatively high in the middle, and relatively low near the end slopes on the two sides. The gradient of 0.3% can effectively enable the water resources to flow to the two sides, and do not waste the construction volume due to an excessive gradient. Meanwhile, in order to reduce the cost, the pit bottom isolation layer 7 may also be replaced with discarded clay, so that the usage of the concrete is reduced, and the construction cost is reduced.

S4: After sealing the bottom, discarding gravel 8 into a pit of the strip mine is started. The discarded gravel is massive gravel having larger holes that is stripped from the strip mine and does not disintegrate while touching water. The height of the discarded gravel 8 is the height of the lowest steps 3 of the end slopes of the strip mine.

S5: During gravel 8 discarding, geotextile is laid when the gravel reaches the height of the lowest steps 3 of the end slopes, so as to form a roof isolation layer 9. Capping work is completed after the roof isolation layer 9 is formed. Waste is normally dumped in the upper inner waste dump 1 at the same time. If a larger storage capacity of water resources is needed, the discarded gravel 8 may be laid to a height higher than the lowest steps 3 of the end slopes so as to increase the water storage capacity. At this time, the height of the corresponding isolation layer is also increased accordingly, so that the sealing property of the reservoir is ensured.

Figure 3:
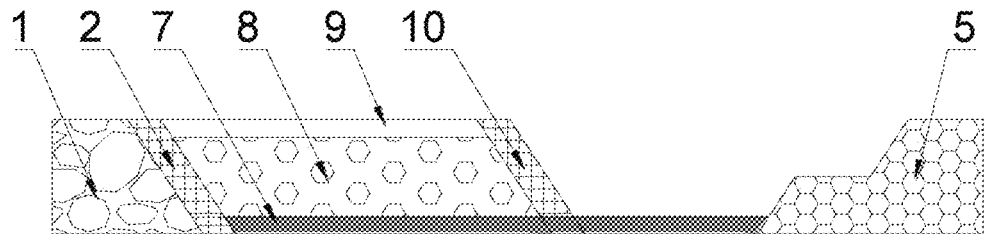
FIG. 3 is a schematic structural view of a completely constructed single reservoir.

S6: As shown in FIG. 3, with gradual forward advancement of the pit of the strip mine, clay is re-adopted on the lowest steps 3 of the end slopes of the inner waste dump 1 while it reaches 150-300 m, so as to form a reservoir sealing isolation layer 10. The construction of a single pit bottom 4 reservoir is completed, namely, reservoir sealing is realized. A plurality of sets of moisture sensors are arranged symmetrically on two sides of each isolation layer to monitor soil moisture in the location in real time.

S7: After the completion of construction of the single reservoir, the above steps are repeated. A plurality of reservoirs are constructed step by step along with advancement of the strip mine in an advancing direction of the strip mine, i.e. a direction from the inner waste dump 1 to a stope 5, so as to form section-by-section reservoirs.

S8: Then the water resources are stored. Firstly installation of water storage wells 11 is completed. During the construction of the single reservoir, holes are directionally drilled in the end slopes on the two sides of the strip mine obliquely downward from the surface. Water pipes are buried. One end of each of the drill holes is located on the surface, and the other end of the drill hole is located in the lower part of the roof isolation layer 9 of the reservoir.

S9: Then installation of water fetching wells 12 is continued to be completed. During the construction of the single reservoir, holes are directionally drilled in the end slopes on the two sides of the strip mine obliquely downward from the surface to form the water fetching wells 12. Pumping units are installed. One end of each of the water fetching wells 12 is located on the surface of the strip mine, and the other end of the water fetching well is located in the upper part of the pit bottom isolation layer 7 of the pit bottom 4 reservoir and near the end slopes.

Figure 4:
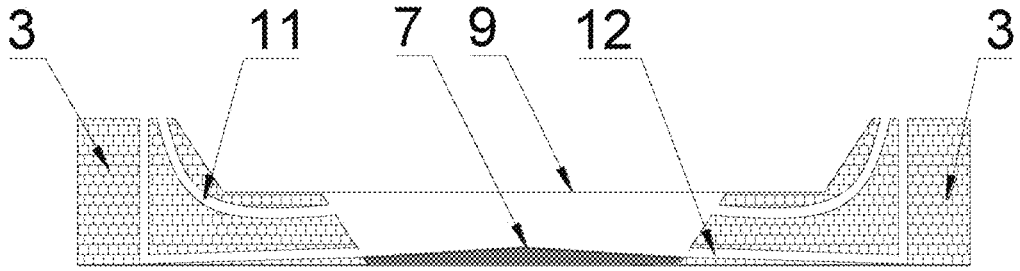
FIG. 4 is a schematic structural view of water storage wells and water fetching wells.

S10: Finally the water resources are stored. After the completion of construction of the single reservoir, the water resources are injected into the pit bottom 4 reservoir via the water storage wells 11. The water resources are stored in the pores of the gravel. When water is needed, the water resources are pumped to the surface via the water fetching wells 12. The slope of the pit bottom isolation layer 7 ensures that the water resources can be gathered to the vicinity of the end slopes as much as possible, thereby ensuring an effect of storing and fetching water, as shown in FIG. 4.

The construction principle of the method for constructing the reservoir section by section according to the present invention is as follows: according to the above steps, starting from the pit of strip mine, after excavation, the inner waste dump isolation layer 2, the end slope isolation layer 6, and the pit bottom isolation layer 7 are gradually formed through concrete guniting or clay discarding; then the geotextile is adopted for capping; then the reservoir sealing isolation layer 10 is constructed to complete the construction of the single reservoir; and the plurality of reservoirs are constructed step by step in the advancing direction of the inner waste dump 1, i.e. the direction towards the stope 5. The water resources are introduced via the water storage wells 11, temporarily stored in the reservoir, and pumped out via the water fetching wells 12 when needed. There is less water loss throughout the process, which effectively reduces the waste of the water resources in coal mine areas in northern China.

What is claimed is:

1. A method for constructing inner dump type strip mine pit bottom reservoirs section by section, comprising procedures of single reservoir construction, multi-reservoir section-by-section construction and water resource storage, and specifically comprising the following steps:

S1: processing side slopes: discarding 5-10-meter-thick clay at a lowest step of an inner waste dump (1) of a strip mine when a width of a constructed pit bottom (4) of the strip mine reaches about 150-300 m, so as to form an inner waste dump isolation layer (2), and stopping advancing of the inner waste dump (1) of the strip mine after the inner waste dump isolation layer (2) is formed;

S2: after processing the side slopes, discharging concrete to slope faces of lowest steps (3) of end slopes on two sides of the pit bottom (4) of the strip mine by adopting a guniting mode, so as to form an end slope isolation layer (6), thus completing end slope processing;

S3: carrying out concrete guniting on the pit bottom (4) of the strip mine, and filling the pit bottom with the concrete and performing compaction to seal the bottom, so as to form a pit bottom isolation layer (7), wherein a laying thickness is 2-5 m, a slope is formed from the surface of the pit bottom isolation layer (7) to the end slopes on the two sides, and the pit bottom (4) is relatively high in the middle, and relatively low near the end slopes on the two sides;

S4: after sealing the bottom, starting discarding gravel (8) into the pit bottom isolation layer of the strip mine, wherein the discarded gravel is massive gravel having larger pores that is stripped from the strip mine and does not disintegrate while touching water, and a height of the discarded gravel (8) is a height of the lowest steps (3) of the end slopes of the strip mine;

S5: during gravel (8) discarding, laying geotextile when the gravel reaches the height of the lowest steps (3) of the end slopes, so as to form a roof isolation layer (9), and completing capping work after the roof isolation layer (9) is formed, wherein waste is normally dumped in an upper inner waste dump (1) at the same time;

S6: with gradual forward advancement of the pit of the strip mine, re-adopting clay on the lowest steps (3) of the end slopes of the inner waste dump (1) while it reaches 150-300 m, so as to form a reservoir sealing isolation layer (10), wherein the construction of a single pit bottom (4) reservoir is completed, namely, reservoir sealing is realized, and a plurality of sets of moisture sensors are arranged symmetrically on two sides of each isolation layer to monitor soil moisture in the location in real time;

S7: after the completion of construction of the single reservoir, repeating the above steps: constructing a plurality of reservoirs step by step along with advancement of the strip mine in an advancing direction of the strip mine, so as to form section-by-section reservoirs;

S8: then storing water resources: firstly completing installation of water storage wells (11): during the construction of the single reservoir, directionally drilling holes in the end slopes on the two sides of the strip mine obliquely downward from the surface, and burying water pipes, wherein one end of each of the drill holes is located on the surface, and the other end of the drill hole is located in the lower part of the roof isolation layer (9) of the reservoir;

S9: then continuing to complete installation of water fetching wells (12): during the construction of the single reservoir, directionally drilling holes in the end slopes on the two sides of the strip mine obliquely downward from the surface to form the water fetching wells (12), and installing pumping units, wherein one end of each of the water fetching wells (12) is located on the surface of the strip mine, and the other end of the water fetching well is located in the upper part of the pit bottom isolation layer (7) of the pit bottom (4) reservoir and near the end slopes; and S10: finally storing the water resources: after the completion of construction of the single reservoir, injecting the water resources into the pit bottom (4) reservoir via the water storage wells (11), wherein the water resources are stored in the pores of the gravel, and when water is needed, the water resources are pumped to the surface via the water fetching wells (12).

2. The method for constructing inner dump type strip mine pit bottom reservoirs section by section according to claim 1, wherein the pit bottom isolation layer (7) in step S3 is capable of being replaced with compacted clay.

3. The method for constructing inner dump type strip mine pit bottom reservoirs section by section according to claim 2, wherein during gravel (8) discarding in step S5, the laying height of the gravel is capable of being adjusted to a height higher than the lowest steps (3) of the end slopes, and at this time, the height of the corresponding isolation layer is also increased accordingly, so that the sealing property of the reservoir is ensured.

4. The method for constructing inner dump type strip mine pit bottom reservoirs section by section according to claim 2, wherein the slope in step S3 is set as a gradient of 0.3%.

5. The method for constructing inner dump type strip mine pit bottom reservoirs section by section according to claim 2 wherein the guniting thickness of the end slope isolation layer (6) in step S2 is 20-50 cm.

6. The method for constructing inner dump type strip mine pit bottom reservoirs section by section according to claim 1, wherein the slope in step S3 is set as a gradient of 0.3%.

7. The method for constructing inner dump type strip mine pit bottom reservoirs section by section according to claim 1, wherein the guniting thickness of the end slope isolation layer (6) in step S2 is 20-50 cm.

8. The method for constructing inner dump type strip mine pit bottom reservoirs section by section according to claim 1, wherein during gravel (8) discarding in step S5, the laying height of the gravel is capable of being adjusted to a height higher than the lowest steps (3) of the end slopes, and at this time, the height of the corresponding isolation layer is also increased accordingly, so that the sealing property of the reservoir is ensured.

* * * * *